US008481834B2

(12) United States Patent
Eduardo

(10) Patent No.: US 8,481,834 B2
(45) Date of Patent: Jul. 9, 2013

(54) CAJON WITH TEXTURED APPLICATIONS

(75) Inventor: Chalo Eduardo, Valencia, CA (US)

(73) Assignee: Remo, Inc., Valencia, CA (US)

( * ) Notice: Subject to any disclaimer, the term of this patent is extended or adjusted under 35 U.S.C. 154(b) by 35 days.

(21) Appl. No.: 13/137,824

(22) Filed: Sep. 15, 2011

(65) Prior Publication Data

US 2013/0068083 A1 Mar. 21, 2013

(51) Int. Cl.
*G10D 13/02* (2006.01)

(52) U.S. Cl.
USPC ..... 84/411 R

(58) Field of Classification Search
USPC ..... 84/411 R, 421
See application file for complete search history.

(56) References Cited

U.S. PATENT DOCUMENTS 5,610,351 A * 3/1997 Yanagisawa ..... 84/422.1
7,482,522 B2 1/2009 Wening
7,485,790 B2 2/2009 Payerl
7,601,901 B2 10/2009 Payerl
7,692,083 B2 4/2010 Aspland
7,816,596 B2 10/2010 Bottger
2012/0132058 A1* 5/2012 Dublin ..... 84/723

FOREIGN PATENT DOCUMENTS

GB 2464727 A * 4/2010
WO WO 2010103199 A1 * 9/2010

* cited by examiner

*Primary Examiner* — Kimberly Lockett

(74) *Attorney, Agent, or Firm* — Beaumont Gitlin Tashjian; Larry F. Gitlin

(57) ABSTRACT

A musical instrument comprising a cuboid-shaped housing with a resonant chamber having external striking surfaces for producing percussive sounds when struck by any portion of a person's hand, or a hard or any other suitable object, and the means for producing distinctive and varied percussive sounds upon the striking of one or more of these surfaces consisting of textured applications joined to one or more of these surfaces in attached or integrated relation.

25 Claims, 6 Drawing Sheets

CAJON WITH TEXTURED APPLICATIONS

FIELD OF THE INVENTION

The present invention relates generally to the field of musical drums and, more particularly, to an improved cajon musical instrument capable of producing a wide range of unique and pleasing percussive sounds.

DESCRIPTION OF THE PRIOR ART

Percussion instruments comprise a wide variety of musical devices well-known in the prior art, including, but not limited to, drums having one or more membranes called drumheads stretched over the end or ends of a hollow cylinder or shell. Sounds are produced by striking the drumhead with a stick, mallet, brush or even the player's hand, or any portion thereof. The sound produced by a drum depends upon a variety of factors, including, among them, but not limited to, the shape, size and thickness of the shell, the materials from which the shell is fabricated, the material comprising the drumhead and the tensioning of the drumhead.

A typical percussive grouping used by bands and orchestras of all types is the common drumset usually comprised of a bass drum, snare drum, tom-tom and cymbals or any combination of these, most supported by metal stands. Also included with the drumsets are pedals to manipulate the cymbals and a mallet or the like for striking the bass drum. A seat or, in the common parlance of the field, a throne, is also provided.

The cajon is a box or cuboid shaped percussion instrument originally from Peru. Because of its ability to produce a multitude of drum sounds by striking one or more sides of the instrument, and its obvious portability, the cajon has grown in popularity and can easily, and often does, provide a viable and more cost effective alternative to the drumset.

A typical cajon has a resonant chamber with an opening or port formed in the back wall for producing bass tones. Within the resonant chamber, attached usually as an option to the inside surface of the front-facing strike plate, are metal strings or snares used to produce a snare sound when the front plate is struck. The cajon panels or walls, because they are relatively thin, operate as vibrating membranes serving the same relative function as a conventional drumhead. Striking a cajon panel or strike plate in different places, e.g. the corners, high or low sections, or the central portion, can thus produce a variety of different and extremely unique and pleasing percussive sounds.

The cajon top panel provides a seat for the player to sit upon while striking the instrument. To play the cajon, the player may use his or her hands, fingers, palms, knuckles and fingernails to produce a multitude of sounds. Mallets, brushes and sticks or any other suitable resilient or hard object may also be used for this purpose.

Many of the advances in cajon technology are disclosed in the following prior art:

U.S. Pat. No. 7,482,522 B2 issued Jan. 27, 2009 to Wening discloses a cajon incorporating a snare carpet that rests against the inside surface of the front panel with the snare carpet actuated by a pedal. Striking the front panel causes the panel to vibrate which, in turn, causes the snare carpet to produce a characteristic snare sound.

U.S. Pat. No. 7,485,790 B2 issued Feb. 3, 2009 to Payerl teaches a cajon made of wooden plates incorporating an apparatus inside the resonant chamber consisting of wires strung in a predetermined arrangement along with associated damping elements for producing sound effects when any of the wooden plates is struck by an object.

U.S. Pat. No. 7,601,901 B2 issued Oct. 13, 2009 to Payerl discloses a cajon with at least one of the striking plates configured ergonomically in a convexly curved manner.

U.S. Pat. No. 7,692,083 B2 issued Apr. 6, 2010 to Aspland teaches a cajon or box drum including a plurality of internal snares which can be compelled to contact one or more of the interior surfaces of the striking plates to produce appropriate snare sounds when the cajon is struck. A bass drum stick or mallet may also be installed inside the resonant chamber for use by the player in selectively striking the instrument to produce unique sounds. An external device, such as a pedal, suitable for operating the bass drum stick may also be provided.

U.S. Pat. No. 7,816,596 B2 issued Oct. 19, 2010 to Bottger discloses a cajon including a housing consisting of sides forming at least one striking plate for producing sounds. Protruding from one or more corners of the strike plate are the means to produce a variety of additional and distinct sound effects, such as rim-shots and rim-clicks. In different embodiments of the invention, a corner may project beyond a recess in the housing or may be attached to the strike plate as a freely vibrating element.

Other cajon improvements include isolating the snare sound from the bass sound, fine tuning the snare tension, or adding jingles or rivets to the instrument to produce distinctive sounds. To augment the sounds of a cajon, players have added other dedicated instruments with, for example, the means to produce sounds and rhythms unique to brush playing (movement of a brush across the surface of a drumhead) or grooved or serrated instruments, such as a guiro.

However, nothing in the prior art includes the improvements of the present invention comprising the use of textured applications joined in attached or integrated relation to one or more of the external surfaces of the walls or striking surfaces of a cajon to produce a range of unique and varied percussive sounds.

SUMMARY OF THE INVENTION

In its preferred embodiment, the present invention provides a musical instrument comprising a cuboid-shaped housing with a resonant chamber having external striking surfaces for producing percussive sounds when struck and the means for producing distinctive and varied percussive sounds upon the striking of one or more of these surfaces consisting of textured applications joined to one or more of these surfaces in attached or integrated relation.

Accordingly, it is an object of the present invention to provide an improved musical instrument that combines a cajon with textured applications installed externally on the cajon's strike plates for producing a range of unique and varied percussive sounds.

It is another object of the present invention to provide an improved musical instrument that combines a cajon with textured applications for producing a range of unique and varied percussive sounds that are directly integrated into the cajon strike plates or integrated into a separate component applied externally to the cajon strike surfaces.

It is another object of the present invention to provide an improved musical instrument that combines a cajon with textured applications for producing a range of unique and varied percussive sounds as a viable alternative to the combined effect of the individual percussive components of a conventional drumset.

Yet another object of the present invention is to provide an improved musical instrument that combines a cajon with textured applications for producing a range of unique and varied percussive sounds that functions also as a place for the player to sit when playing the instrument.

It is yet another object of the present invention to provide an improved cajon that employs a player's hand, or any portion thereof, a stick, mallet, or brush, or the like, to strike or make appropriate contact with, textured applications attached to or integrated into the cajon's strike plates.

It is yet another object of the present invention to provide an improved musical instrument that combines a cajon with textured applications for producing a range of unique and varied percussive sounds that is easy and cost effective to manufacture and use.

Other objects and advantages of the present invention will become apparent in the following specifications when considered in light of the attached drawings wherein the preferred embodiment of the invention is illustrated.

DETAILED DESCRIPTION OF THE PREFERRED EMBODIMENT

Figure 1:
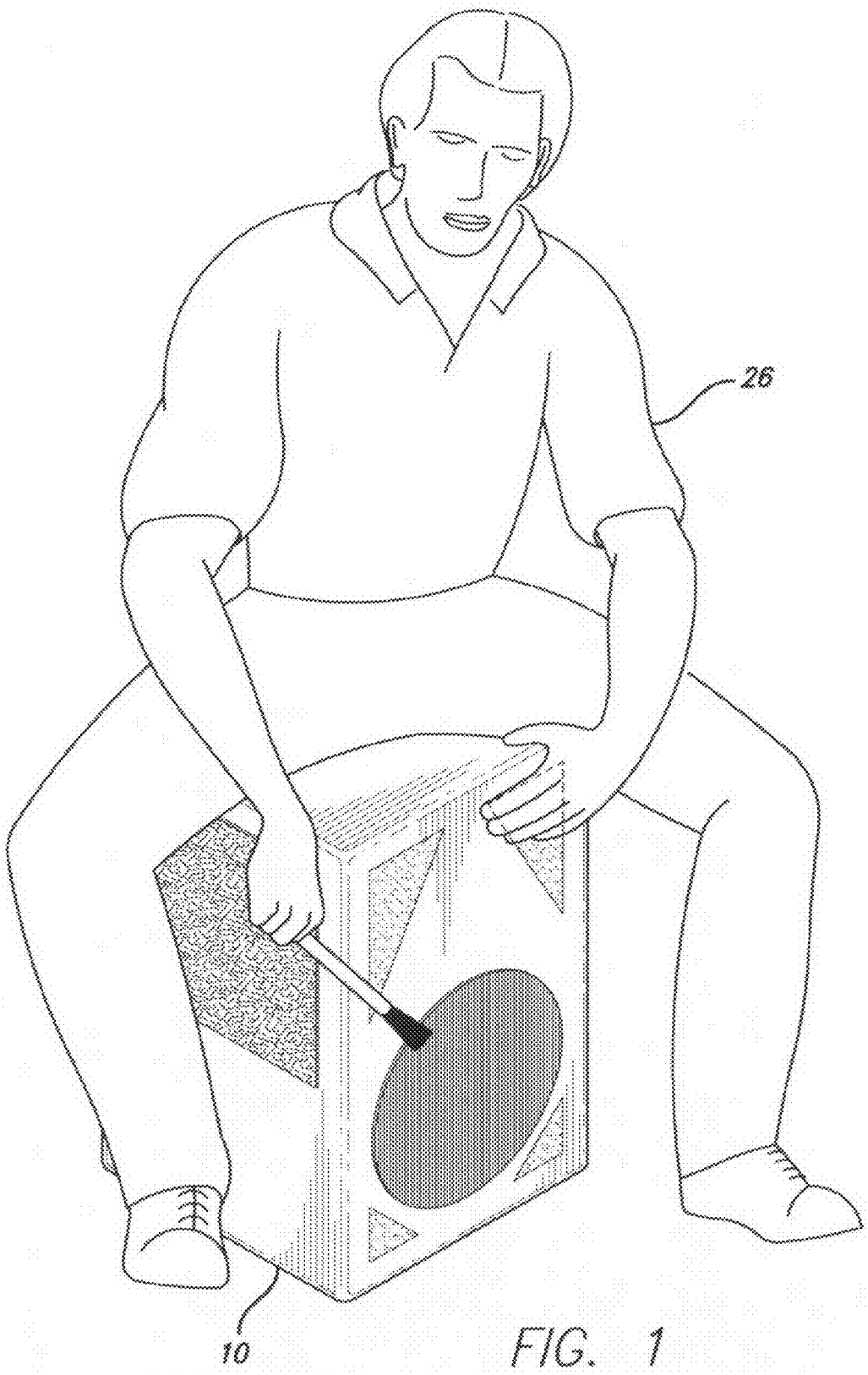
FIG. 1 is a front perspective view of the improved cajon in accordance with the present invention shown with a player sitting on top playing the cajon with his hand and a brush implement.
Figure 2A:
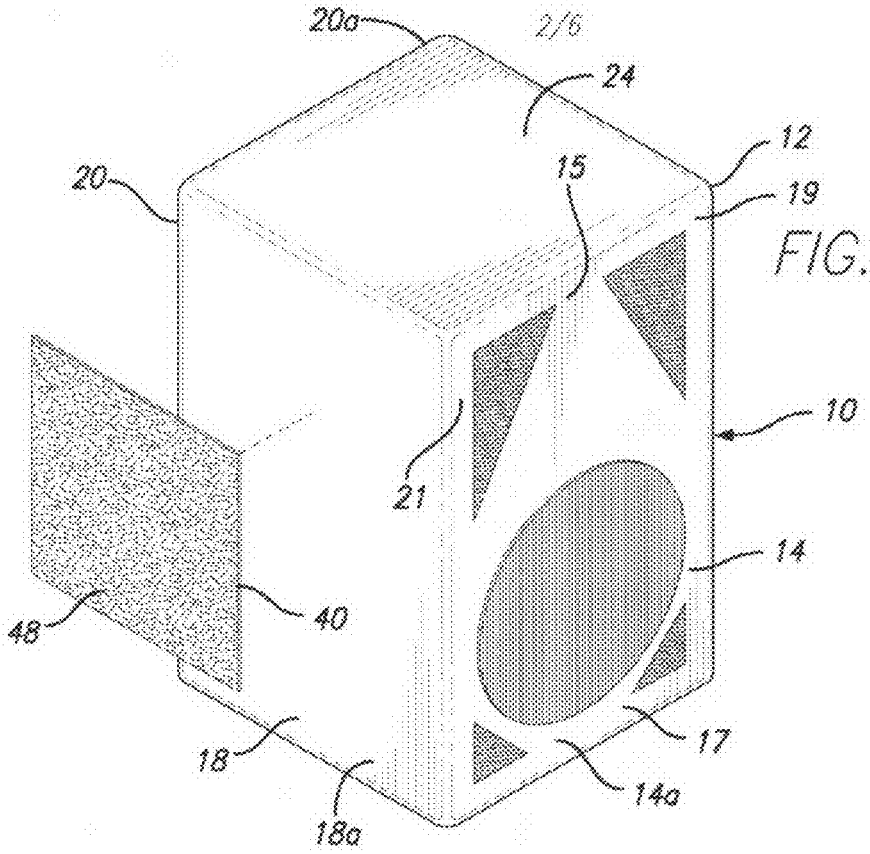
FIG. 2A is a front perspective view of the improved cajon in accordance with the present invention illustrating the installation of a textured application to one side strike plate of the cajon.
Figure 2B:
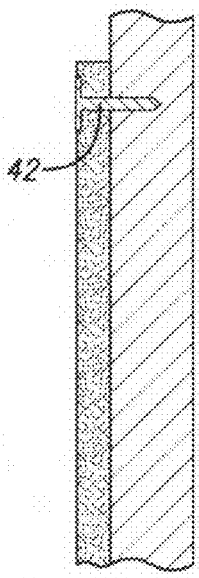
FIG. 2B is a cross-sectional view of the improved cajon in accordance with the present invention illustrating one method of installing a textured application to one side strike plate of the cajon.
Figure 2C:
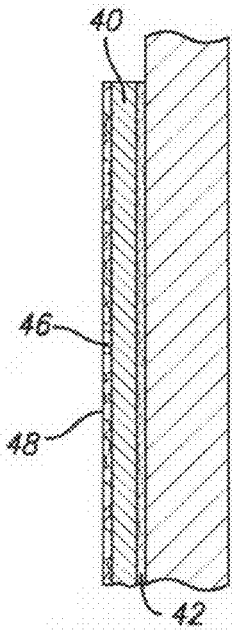
FIG. 2C is a cross-sectional view of the improved cajon in accordance with the present invention illustrating an alternative method of installing a textured application to one side strike plate of the cajon.
Figure 3:
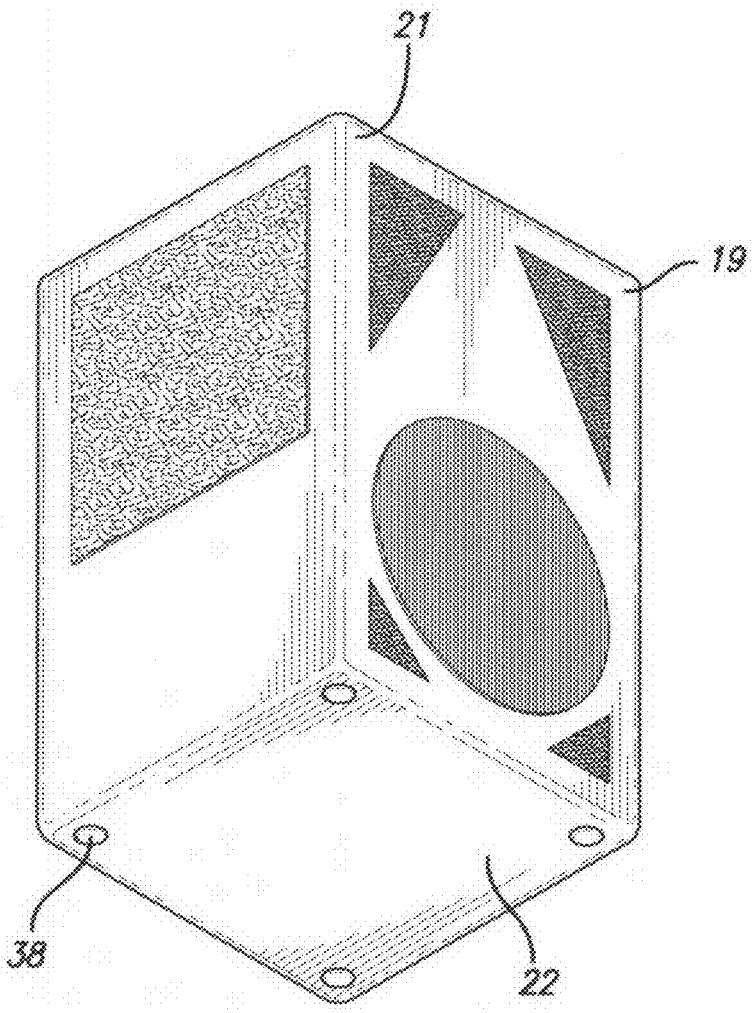
FIG. 3 is a bottom perspective view of the improved cajon in accordance with the present invention with textured applications shown installed on the front strike plate and one side strike plate of the cajon.
Figure 4:
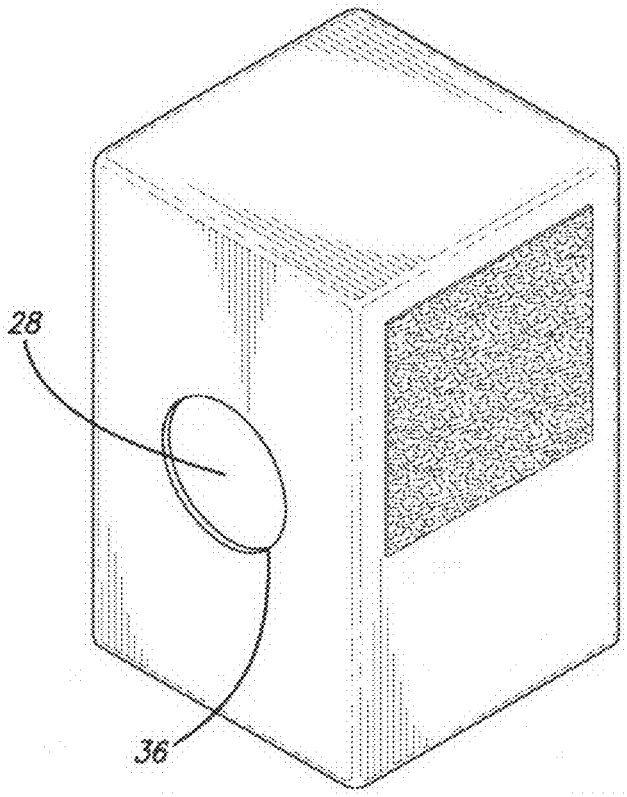
FIG. 4 is a rear perspective view of the improved cajon in accordance with the present invention with a textured application shown installed on one side strike plate of the cajon and a port formed in the back wall.
Figure 5:
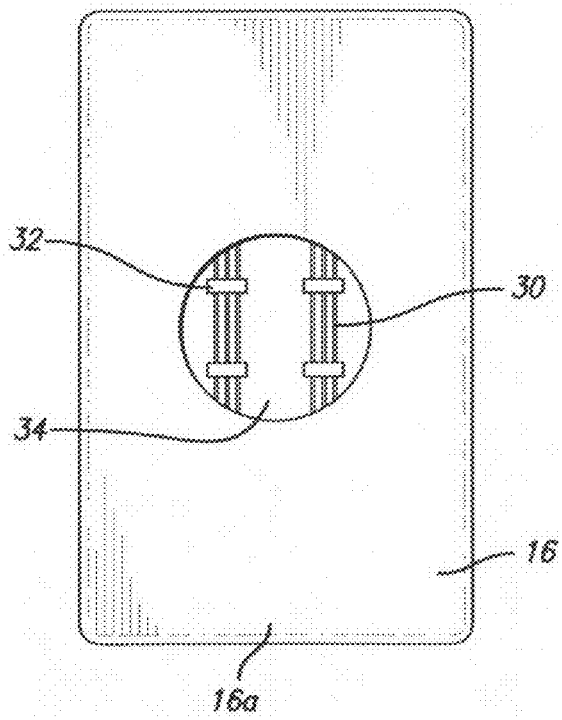
FIG. 5 is a rear elevational view of the improved cajon in accordance with the present invention with a port shown in the back wall and snares installed inside the resonant chamber.
Figure 6A:
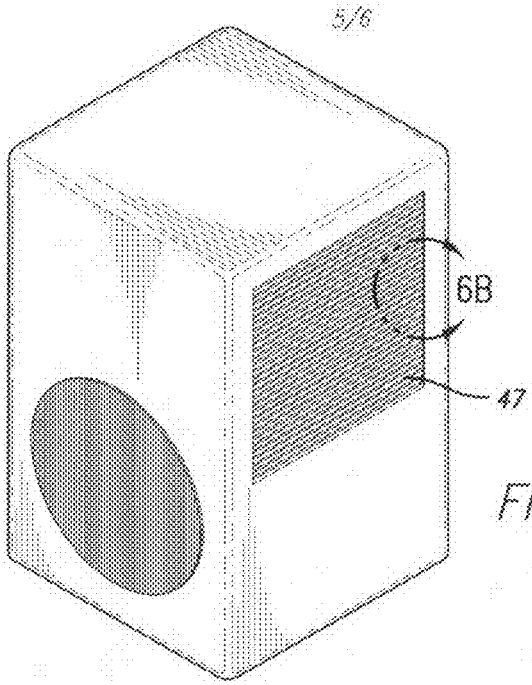
FIG. 6A is a perspective view of the improved cajon in accordance with the present invention with an alternative textured application integrated into one side strike plate of the cajon.
Figure 6B:
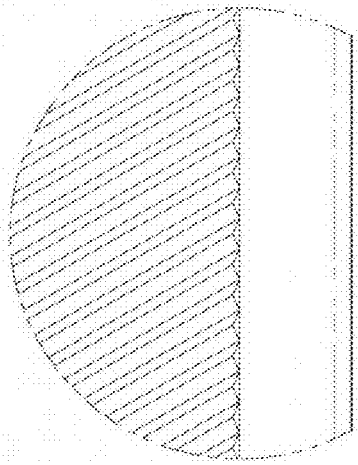
FIG. 6B is an enlarged perspective view of the cajon in accordance with the present invention shown encircled by line 6B in FIG. 6A.
Figure 7:
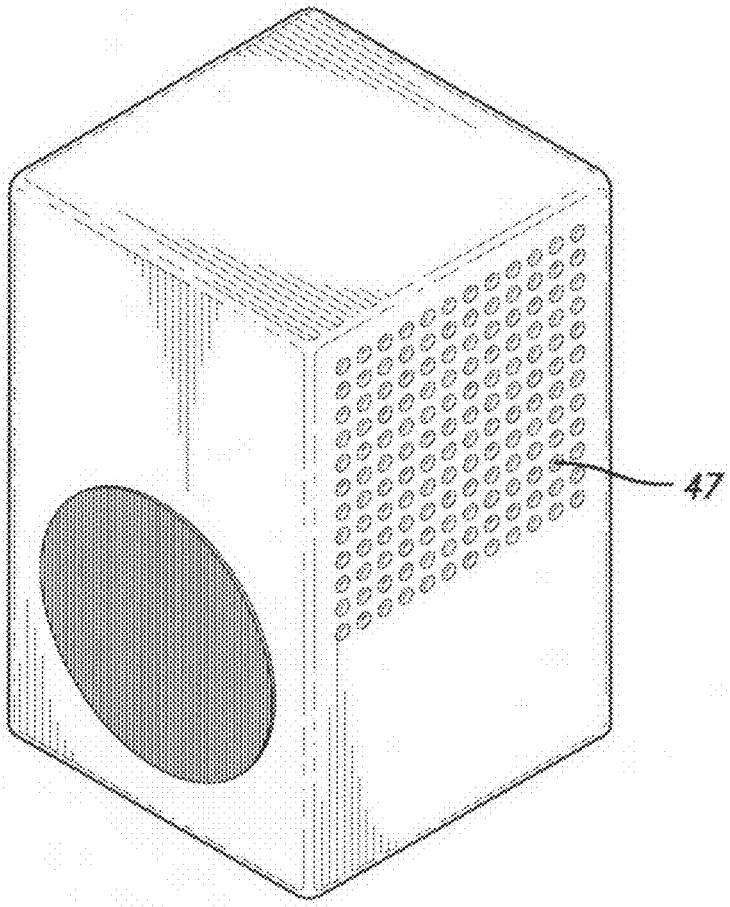
FIG. 7 is a perspective view of the improved cajon in accordance with the present invention with a second alternative textured application integrated into one side strike plate of the cajon.

FIG. 1 illustrates the preferred embodiment of the improved cajon in accordance with the present invention.

Cajon 10 comprises a block or cuboid shaped shell 12 having front strike plate 14, back plate 16, first side strike plate 18 and second side strike plate 20, which are integrally joined as a single unit or employ several individual sections or panels to form shell 12. Each plate 14, 16, 18 and 20 includes upper section 15 and lower section 17, and each upper section 15 and lower section 17 includes right corner section 19 and left corner section 21. Also included is bottom panel 22 and top panel 24, which also functions as a seat for player 26. Inside shell 12 is resonant chamber 28, which may include one or more sets of snare wires 30 utilizing support brackets 32 for installation of snare wires 30 on interior surface 34 of front strike plate 14. Formed within back plate 16 is port 36 to enable the production of bass sounds. Foot pads 38 are installed at each of the corners of bottom panel 22 to assist in stabilizing cajon 10 when positioned to sit upon and play.

Cajons, though traditionally cuboid in shape, may also be produced in the following geometric configurations: octagonal, pentagonal, rectangular, triangular, hexagonal, heptagonal, conical, and round, employing individual pieces or panels to fashion the instrument or a single continuous piece or panel as required (not shown).

Shell 12 may be fabricated of a variety of materials, including, without limitation, wood, MDF, fiberglass, molded plastic, sheet metal and plastic sheets.

Attached to either front strike plate 14, first side plate 18, second side plate 20 and/or back plate 16 are one or more base pads 40 provided in a myriad of optional geometric shapes (e.g. round, square, rectangular, triangular, oval, etc.) made from a variety of materials including, without limitation, coated polyester sheets (e.g. MYLAR®), thermoset or thermoformed plastics, assorted types of fabric, foam or sponge materials, random oriented fiber sheet materials (e.g. TYVEK® or REEMAY®), and random woven patterns created with natural or synthetic yarns. Base pads 40 may be generally flat, concave, or convex, as desired, and are usually, but not exclusively, produced using the conventional dye-cutting method of manufacture.

Each base pad 40 may be attached to front strike plate 14, back plate 16, first side strike plate 18 and/or second side strike plate 20 employing a wide variety of attachment means 42 including, without limitation, adhesives, employing any suitable adhesive material and non-adhesive means, including, but not limited to, nails, staples, tacks, rivets, plastic fasteners, ultrasonic welds, stitches or magnets.

Textured application 48 attached or applied to surface 46 of base pad 40 and the variety of patterns that may result may be produced using a variety of application techniques, methods, and materials, including, but not limited to, polyester, fabric, film, glass beads, resins, sandpaper, sandblasting, cloth, brush, sponge, foam, roller, spray, print and silkscreening.

Textured application 48 may also be integrated directly into base pad 40, as an amalgamated composite, rather than simply attaching textured application 48 as a separate component to surface 46, or even directly into surfaces 14*a*, 16*a*, 18*a* and 20*a* of plates 14, 16, 18 and 20, respectively, as one of several alternative textured applications 47, utilizing any one of several alternative means, including, without limitation, the subtractive processes of planing, saw, water jet or laser cutting, carving, stamping, printing, inscribing, incising, ensculpting, scoring, scratching, scraping, sanding, routing, sandblasting, etching, and the displacement process of embossing.

Various implements may be employed to strike or make contact with any textured application 47 or 48 wherever it may be installed on or employed in connection with cajon 10 to create a variety of desired unique and pleasing percussive sounds. Examples include, without limitation, sticks, brushes and mallets, and the player's own hand, including individually the fingers, fingertips, and palms, or any combination of these.

While the invention will be described in connection with a certain preferred embodiment, it is to be understood that it is not intended to limit the invention to that embodiment. Rather, it is intended to cover all alternatives, modifications and equivalents as may be included within the spirit and scope of the invention as defined by the appended claims.

The invention claimed is:

1. A musical instrument, comprising:

a cuboid housing with a resonant chamber fashioned from a plurality of panels integrated as an amalgamated unit or combined as individual pieces to form said housing, each of said panels having a corresponding external surface; and, means for producing distinctive percussive sounds upon the striking of one or more of said external surfaces comprising one or more textured applications joined to said external surfaces in attached relation, wherein each of said attached textured applications comprises a base pad joined with a textured material, said textured material being amalgamated with said base pad or brought together as a separate component with said base pad and united.

2. The musical instrument according to claim 1, wherein said textured material is comprised of polyester.

3. The musical instrument according to claim 1, wherein said textured material is comprised of fabric.

4. The musical instrument according to claim 1, wherein said textured material is comprised of a brush material.

5. The musical instrument according to claim 1, wherein said textured material is comprised of sponge material.

6. The musical instrument according to claim 1, wherein said textured material is comprised of foam material.

7. The musical instrument according to claim 1, wherein said textured material is comprised of a silkscreened image.

8. The musical instrument according to claim 1, wherein said textured material is comprised of film material.

9. The musical instrument according to claim 1, wherein said textured material is comprised of resin.

10. The musical instrument according to claim 1, wherein said textured material is comprised of sandpaper material.

11. The musical instrument according to claim 1, wherein said textured material is comprised of sandblasted material.

12. The musical instrument according to claim 1, wherein said textured material is comprised of said base pad joined with a plurality of glass beads.

13. The musical instrument according to claim 1, wherein each of said attached textured applications comprises said base pad joined with thermoset plastic material, said thermoset plastic material being amalgamated with said base pad or brought together as a separate component with said base pad and united.

14. The musical instrument according to claim 1, wherein each of said attached textured applications comprises said base pad joined with thermoformed plastic material, said thermoformed plastic material being amalgamated with said base pad or brought together as a separate component with said base pad and united.

15. The musical instrument according to claim 1, wherein each of said attached textured applications comprises said base pad joined with a composite of random-orientated fibers, said composite of random-orientated fibers being amalgamated with said base pad or brought together as a separate component with said base pad and united.

16. The musical instrument according to claim 1, wherein each of said attached textured applications comprises material fabricated of woven patterns of natural or synthetic yarns.

17. The musical instrument according to claim 1, wherein said textured material as a separate component is united with said base pad or said base pad is amalgamated with said textured material and affixed to one or more of said external surfaces by adhesive means.

18. The musical instrument according to claim 1, wherein said textured material as a separate component is united with said base pad or said base pad is amalgamated with said textured material and affixed to one or more of said external surfaces by non-adhesive means.

19. The musical instrument according to claim 18, wherein said non-adhesive means comprises one or more nails.

20. The musical instrument according to claim 18, wherein said non-adhesive means comprises one or more rivets.

21. The musical instrument according to claim 18, wherein said non-adhesive means comprises one or more tacks.

22. The musical instrument according to claim 18, wherein said non-adhesive means comprises one or more plastic fasteners.

23. The musical instrument according to claim 18, wherein said non-adhesive means comprises one or more ultrasonic welds.

24. The musical instrument according to claim 18, wherein said non-adhesive means comprises one or more stitches.

25. The musical instrument according to claim 18, wherein said non-adhesive means comprises one or more magnets.

* * * * *